United States Patent [19]

Roberts

[11] 4,350,278

[45] Sep. 21, 1982

[54] DEMAND DRIVE COMPONENT

[76] Inventor: Marvin A. Roberts, 7900 Alabama Ave., Canoga Park, Calif. 91304

[21] Appl. No.: 200,883

[22] Filed: Oct. 27, 1980

[51] Int. Cl.[3] ..... B65H 17/20

[52] U.S. Cl. ..... 226/190; 242/209

[58] Field of Search ..... 226/189–191, 226/195, 118, 193; 242/55.01, 206, 208–210

[56] References Cited

U.S. PATENT DOCUMENTS

| | | | |
|---|---|---|---|
| 3,253,758 | 5/1966 | Horiuchi | 226/181 |
| 3,441,463 | 4/1969 | Buck | 226/193 X |
| 4,215,827 | 8/1980 | Roberts et al. | 242/55.01 |

*Primary Examiner*—Leonard D. Christian
*Attorney, Agent, or Firm*—Roger H. Marrs

[57] ABSTRACT

A drive puck for use as a component in a demand drive system is disclosed herein in which a film roller is resiliently centered on a rotating drive shaft so that the tension of a film strip carried thereon selectively causes engagement of the film roller with the drive puck. The puck is secured to the drive shaft so as to rotate therewith and is provided with an external tread which projects into a lateral cavity of the film roller so as to engage with the underside of the film roller in response to the resilient centering movement of the film roller.

1 Claim, 4 Drawing Figures

DEMAND DRIVE COMPONENT

BACKGROUND OF THE INVENTION

1. Field of the Invention

The present invention relates a film tension control mechanism for a demand drive system employed in a photographic processing apparatus and more particularly, to a novel drive component included in the mechanism which produces greater torque than can be otherwise achieved.

2. Brief Description of the Prior Art

To increase the efficiency of printing multiple copies of motion pictures, microfilm, and other photographic duplicating film, a device is needed to transport-in-storage all of the continuous-web loop external to the printer. Typically, in the past, rollers were mounted in pairs on a panel and the film looped over the rollers in a seesaw pattern and then back to the printer. More recently loop cabinets have been produced with multiple shafts, each carrying numerous rollers. The film traveled from the printer to the cabinet, and was threaded in loops around top and bottom roller pairs, first across the first pair of shafts, then across the second, and so on until the cabinet was filled or all of the film was stored. To accommodate for various film lengths, the upper shafts mounting the rollers were fixed at the top of the cabinet and were all driven by a common motor. The lower shafts were mounted in a frame. A means was provided to adjust the space between upper and lower rollers by raising or lowering the lower frame. Sometimes, this was done with the aid of springs, weights, or levers; and sometimes by a manually-controlled motor.

To assist in film transport through the cabinet, the metal rollers were mounted on roller bearings. A motor turned all shafts on the top frame in the direction of film travel. The turning shafts caused the rollers to lose their resistance to being turned by the moving film passing over them. Without this aid, film tension would become too great and the film would break.

Equipment of the type described above is currently in common use throughout photographic and motion picture laboratories. However, there are numerous drawbacks to the loop cabinets now in use. For example, loading the cabinet presents problems because all roller shafts are motorized from a single motor and individual shafts cannot vary their speeds to take up more film when film length is increased or decreased. In addition, since the rollers are metal, they have a great deal of inertia and cannot rapidly change speed to match start and stop acceleration and deceleration. Further, since the rollers are not driven, slack accumulates quickly, and the operator must manually make adjustments, and sometimes move the cabinet closer to or further from the printer to compensate for film length changes. In addition, present loop cabinets have a maximum capacity often less than the length of the master to be accommodated. All of these factors contribute to limiting the throughput of the printer, thereby reducing the production efficiency of the laboratory.

An improved film loop cabinet which solves most of the problems mentioned above is shown and described in U.S. Pat. No. 4,215,827 which employs positive demand drive for the film footage and associated sensors therefor for transportation-in-storage of a continuous film loop external to a film printer. Low mass plastic film rollers equipped with soft-touch rubber surfaces are employed for transporting this film. Each roller includes a spring bias means for automatically adjusting to the tension of the film length trained thereover.

Similar rollers or spool devices are noted in U.S. Pat. Nos. 3,369,765 and 3,380,678. However, problems and difficulties have been encountered with prior roller or spool devices which stem largely from the fact that slippage occurs between the roller surface and the smooth surface of the film and insufficient torque is achieved to drive some film as required.

Therefore, a long standing need has existed to provide a drive roller or spool which will start to drive with less displacement and which will provide more surface contact with the film roller for moving the film.

SUMMARY OF THE INVENTION

Accordingly, the above problems and difficulties are obviated by the present invention which provides a novel drive puck for use in driving a film roller in a positive demand drive system in which the film roller is resiliently centered on a rotating drive shaft whereby the tension of a film length carried thereon selectively causes engagement of the film roller with the drive puck. The drive puck is secured to the drive shaft so as to rotate therewith and is provided with an external tread means which projects into a lateral cavity of the film roller so as to engage with the underside of the film roller in response to the resilient centering movement of the film roller.

Therefore, it is among the primary objects of the present invention to provide a novel drive puck in a positive demand drive system which provides more torque than conventional drive pucks in such systems.

Another object of the present invention is to provide a novel drive puck in a positive drive system for processing photographic film which includes an irregular surface for selectively engaging with a regular surface on a film roller whereby greater torque is achieved.

Still a further object of the present invention is to provide a novel drive puck used in combination with a film roller which creates a "fluid drive" action by means of an irregular or tread surface on the drive puck which is intended to engage with a smooth surface on the film roller.

Yet a further object of the present invention is to provide a novel drive puck which may be used or employed in situations requiring greater torque than can be handled by conventional pucks.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

DESCRIPTION OF PREFERRED EMBODIMENT

Figure 1:
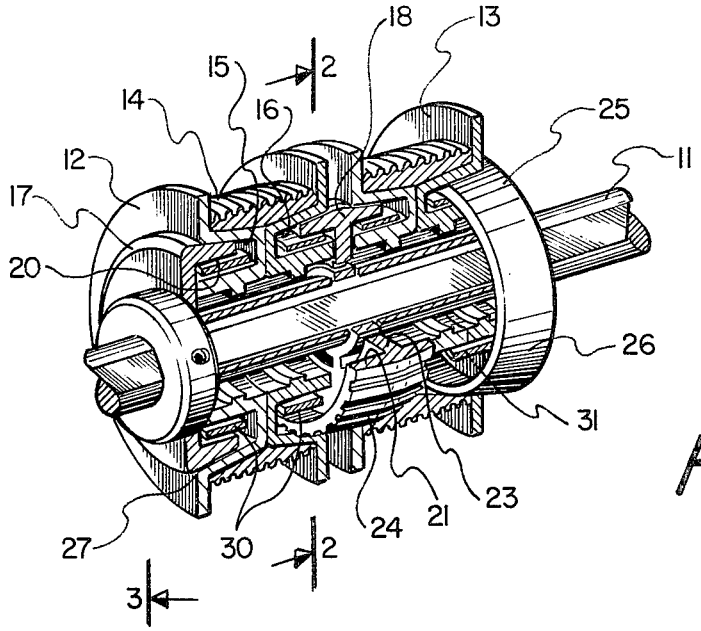
FIG. 1 is a perspective view of the novel drive puck used in a film drive system and illustrated partly in section to expose internal components thereof.

Referring to FIG. 1, a demand drive roller system is indicated in the general direction of arrow 10 which includes a driveshaft 11 that may be driven by any suitable means such as a low-inertia torque motor. In the demand drive roller system 10, film rollers 12 and 13 can act as idlers or drivers depending on the tension requirements at any given instant. The film rollers 12 and 13 are composed of plastic and are provided with a Silicone tire 14 on which a length of film (not shown) is trained. Each film roller is provided with a pair of lateral cavities indicated with respect to roller 12 by numerals 15 and 16 which are partially occupied by flanges carried on drive pucks 17 an 18. In the present drive system, puck 17 is one half of the drive puck 18 and therefore drive puck 17 is referred to as an end puck and includes a single flange 20 which is introduced into the cavity 15. The full drive puck 18 includes flanges 21 and 22 which occupy cavity 16 associated with film roller 12 and the adjacent cavity in film roller 13. It is to be particuarly noticed that the flanges 21 and 22 of the full drive puck 18 outwardly extend from opposite sides of a web 23 and that the outer exposed surface of the full drive puck 18 includes a plurality of ridges defining an irregular surface to form a tread 24.

The end pucks 17 and 25 as well as the full drive puck 18 are fixly secured to the shaft 11 by corresponding flat surfaces which are pressed into registered position. The end pucks are formed with flat outer surface such as indicated by numeral 26 with respect to end puck 25 and numeral 27 with respect to end puck 17. The drive puck surfaces 26, 27 and tread 24 are intended to be selectively engaged in driving relationship with the upper or outer cavity defining surfaces in their respective cavities carried on the film rollers 12 and 13 respectively. The selective engagement is set forth by the bias of a spiral spring which resiliently carries the film rollers 12 and 13 onto the rotating shaft 11. The springs are broadly identified by numerals 30 and 31 associated with each of the film rollers 12 and 13 respectively. Each roller is evenly centered about the puck and shaft and held in this position by the centering springs 30 and 31.

Figure 2:
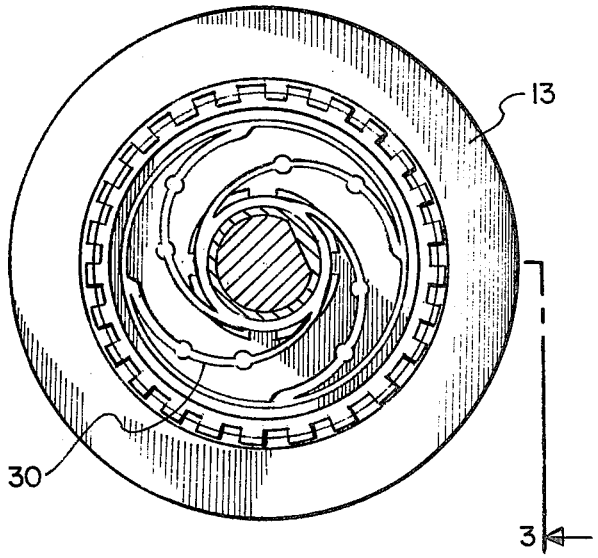
FIG. 2 is an enlarged cross sectional view of the novel drive puck used in the drive system of FIG. 1 as taken in the direction of arrows 2—2 thereof.
Figure 3:
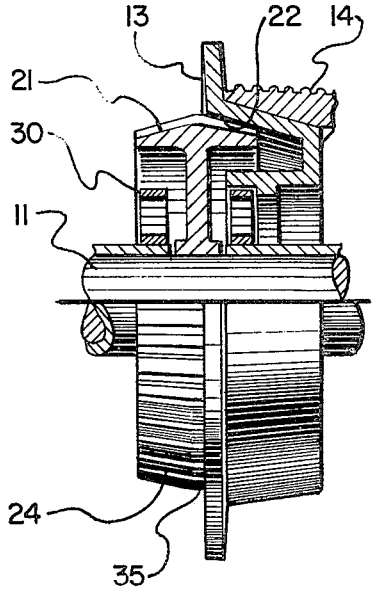
FIG. 3 is a sectional view of the drive puck as taken in the direction of arrows 3—3 of FIG. 2.

As shown in FIG. 2, a condition is illustrated wherein the roller 12 is in a no-demand situation while FIG. 3 illustrates how tension on the film deflects the spring 31 and enables the drive puck to engage and turn the film roller 13. Obviously, film roller 12 will also turn since flange 21 will engage therewith in a similar fashion as flange 22 engaging with the roller 13. As can be understood, as the tension is transferred between the conditions, spring 30 as well as spring 31 is deflected and the roller changes from idler to a driven roller. It is to be understood that the present invention does not intend to cover the spring mounting of the film rollers onto the drive shaft 11. The spiral springs are readily disclosed and described in U.S. Pat. No. 3,369,765.

Figure 4:
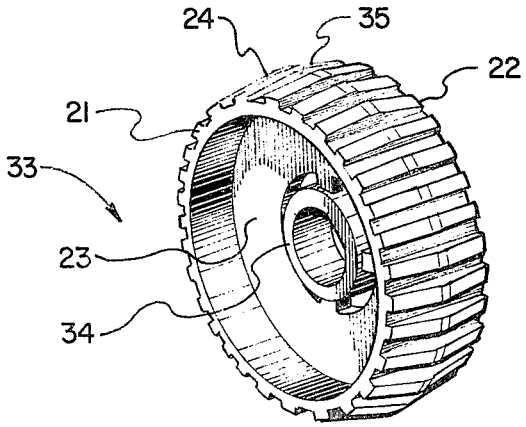
FIG. 4 is a perspective view of the novel drive puck employed in FIGS. 1–3 inclusive.

The novel drive puck illustrated as a full drive puck is shown in FIG. 4 in the general direction of arrow 33 and it can be seen that a hub 34 mounts in securement by means of corresponding flats to the drive shaft 11. The puck further includes a web 23 which outwardly radiates from the hub 34 terminating in the rim or flanges 21 and 22. Not only is the outer surface of the flanges formed with tread 24 but it can be seen that the two outer surfaces slightly diverge from the center line which is indicated by numeral 35. The center line 35 is disposed between the opposing surfaces of the adjacent film rollers 12 and 13 so that the respective flanges 21 and 22 can project and partially occupy the cavities formed in each of the film rollers. The ridges forming the tread 24 provide an extra measure of diameter so that a tighter engagement with the film roller surface is achieved. The irregular surface also provides for a greater gripping action and therefore a greater torque is provided than can otherwise be gained when employing smooth or flat surfaces. It is to be borne in mind that it is not the purpose of the inventive drive puck to replace prior or conventional pucks which may include flat or smooth surfaces but rather the inventive drive puck is needed and is employed in situations in which greater torque is a requirement. In these latter instances, smooth or flat surfaced drive rollers cannot properly drive the film rollers.

In view of the foregoing, it can be seen that the employment of an external tread 24 achieves more torque than a smooth surface. This is achieved in two ways: first, the inventive drive puck has a slightly larger diameter than a smooth puck would have and secondly, the inventive drive puck has the ridges or a "tread" on its surface for greater grasping engagement. The larger diameter provides two actions which are unavailable with a smooth surface. The first action starts driving with less displacement of the spring and secondly, more surface is in contact with the film roller. Furthermore, the tread 24 offers more traction but also creates a "fluid drive" action.

If even greater torque is required, the end pucks 17 and 25 may also employ the tread 24 ridges which are illustrated with respect to the full drive puck 18.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a film transport system comprising the combination of a rotatable shaft, a unitary film support roller arranged for rotation about said shaft;

a substantially rigid central hub portion disposed substantially coaxial with said shaft and arranged to rotate thereabout;

a substantially rigid constant diameter rim portion disposed about and having a larger diameter than said hub;

at least one flexible member connecting said rim portion to said hub portion whereby said rim portion may rotate about said hub at varying radial distances;

means for driving said roller comprising a drive puck arranged to rotate with said shaft and upon radial deflection of said rim portion to engage and drive said roller;

said drive puck coaxially arranged with said shaft, and said hub;

drive puck having an outer peripheral irregular surface which contacts the underside of said roller upon radial deflection of said rim portion;

said roller is provided with at least one lateral cavity defining said roller underside and wherein said drive puck is disposed within said lateral cavity;

said drive puck irregular surface comprising a plurality of spaced apart ridges laterally disposed across the width in parallel relationship;

said drive puck irregular surface includes a central crown mid-way between its side edges and said ridges diverge towards said side edges from said crown.

* * * * *